US008443728B2

(12) United States Patent
Chiang et al.

(10) Patent No.: US 8,443,728 B2
(45) Date of Patent: May 21, 2013

(54) IMPACT FUZE FOR A HIGH-SPIN SELF-DESTRUCTING DEVICE

(75) Inventors: Li-Tin Chiang, Taipei (TW); Chun-Wei Chiu, New Taipei (TW); Kuei-Ju Lee, New Taipei (TW)

(73) Assignee: Chung-Shan Institute of Science and Technology, Armaments, Bureau, Ministry of National Defense, Taoyuan County (TW)

( * ) Notice: Subject to any disclaimer, the term of this patent is extended or adjusted under 35 U.S.C. 154(b) by 0 days.

(21) Appl. No.: 13/242,570

(22) Filed: Sep. 23, 2011

(65) Prior Publication Data

US 2013/0074723 A1 Mar. 28, 2013

(51) Int. Cl.
*F42C 15/188* (2006.01)
*F42C 15/22* (2006.01)

(52) U.S. Cl.
USPC ..... 102/245; 102/237; 102/239; 102/242; 102/256; 102/274

(58) Field of Classification Search
USPC ..... 102/216, 237, 239, 242, 245, 272, 102/274, 254, 256
See application file for complete search history.

(56) References Cited

U.S. PATENT DOCUMENTS

| | | | | | |
|---|---|---|---|---|---|
| 2,458,405 | A * | 1/1949 | Nichols | 102/236 |
| 2,871,788 | A * | 2/1959 | Guerne | 102/239 |
| 2,924,176 | A * | 2/1960 | Neuwirth et al. | 102/267 |
| 3,177,810 | A * | 4/1965 | Kipfer | 102/245 |
| 3,397,640 | A * | 8/1968 | Ziemba | 102/243 |
| 3,616,757 | A * | 11/1971 | Berger | 102/245 |
| 3,994,230 | A | 11/1976 | Kalin | |
| 3,995,557 | A * | 12/1976 | Engel et al. | 102/267 |
| 4,213,395 | A * | 7/1980 | Breed | 102/236 |
| 4,242,693 | A | 12/1980 | Biran | |
| 4,242,963 | A * | 1/1981 | Ziemba | 102/236 |
| 4,406,225 | A * | 9/1983 | Backstein et al. | 102/235 |
| 4,535,695 | A * | 8/1985 | Winterhalter | 102/240 |
| 5,355,801 | A * | 10/1994 | Donahue et al. | 102/233 |
| 7,357,081 | B2 * | 4/2008 | Zinell et al. | 102/245 |
| 7,461,596 | B2 * | 12/2008 | Zinell et al. | 102/235 |
| 8,082,845 | B2 * | 12/2011 | Aw et al. | 102/274 |

* cited by examiner

*Primary Examiner* — James Bergin
(74) *Attorney, Agent, or Firm* — Jackson IPG PLLC

(57) ABSTRACT

A fuze includes a shell, a plunger a firing pin unit, a spring, a receptacle, a plurality of detents, a detonation unit and a restraint unit. The plunger is movably provided in the shell. The firing pin unit is movably provided in the shell, in the vicinity of the plunger. The spring is compressed between the plunger and the firing pin unit. The receptacle is provided in the shell and movably connected to the firing pin unit. The detents are movably provided between the firing pin unit and the receptacle. The detonation unit is movably provided in the receptacle opposite to the detents. The restraint unit is provided in the shell and movably connected to the detonation unit.

6 Claims, 5 Drawing Sheets

IMPACT FUZE FOR A HIGH-SPIN SELF-DESTRUCTING DEVICE

BACKGROUND OF INVENTION

1. Field of Invention

The present invention relates to a high-spin self-destructing device and, more particularly, to a fuze for a high-spin self-destructing device.

2. Related Prior Art

Referring to FIG. 5, a conventional laze 9 includes a shell 90, a firing pin 91 provided in the shell 90, a rotor 92 movably provided in the shell 90, a detonator 93 provided in the rotor 92, and a spring 94 for biasing the rotor 92. The conventional fuze 9 can be used together with a projectile. After the projectile is projected from a launcher, the spring 94 is disengaged from the rotor 92 because of the gravity so that the detonator 93 and the firing pin 91 are in a ready position. When the projectile reaches a target, the shell 90 is hit and deformed so that the firing pin 91 is pushed against the detonator 93, i.e., the detonator 93 is pushed by the firing 91 for detonate dynamite loaded in the projectile.

The conventional fuze 9 however includes the firing pin 91 for triggering the detonator 93 in a mechanical manner. If the fuze 9 is not subject to a sufficient impact, it cannot be operated normally, thus rendering a dangerous state during the movement of the rotor 82 into the ready position. Moreover, the rotor 92 and the detonator 93 are only restrained by the spring 94 to avoid the rotor 92 from rotation. Once the spring 94 is fractured or broke, the rotor 92 can easily be moved to the ready position when it is not launched from the launcher. Thus, the dynamite could be detonated accidentally, and this is not in compliance with the regulations of MIL-STD-1316.

The present invention is therefore intended to obviate or at least alleviate the problems encountered in prior art.

SUMMARY OF INVENTION

It is the primary objective of the present invention to provide a reliable fuze for a high-spin self-destructing device.

To achieve the foregoing objective, the fuze includes a shell, a plunger a firing pin unit, a spring, a receptacle, a plurality of detents, a detonation unit and a restraint unit. The plunger is movably provided in the shell. The firing pin unit is movably provided in the shell, in the vicinity of the plunger. The spring is compressed between the plunger and the firing pin unit. The receptacle is provided in the shell and movably connected to the firing pin unit. The detents are movably provided between the firing pin unit and the receptacle. The detonation unit is movably provided in the receptacle opposite to the detents. The restraint unit is provided in the shell and movably connected to the detonation unit.

In an aspect, the shell can be made with various sizes.

In another aspect, the firing pin unit includes a seat provided in the receptacle and a firing pin provided in the seat. The spring is provided on and around the firing pin so that the spring is in contact with the plunger at an end and in contact with the seat at an opposite end.

In another aspect, the seat includes a plurality of apertures for containing the plurality of detents.

In another aspect, the receptacle includes a chamfered portion in contact with the detents.

In another aspect, each of the detents is a ball.

In another aspect, the detonation unit includes a rotor movably connected to restraint unit and a detonator provided in the rotor.

In another aspect, the restraint unit includes a centrifugal pin movably connected to the detonation unit and a centrifugal coil spring connected to the centrifugal pin.

Other objectives, advantages and features of the present invention will be apparent from the following description referring to the attached drawings.

BRIEF DESCRIPTION OF DRAWINGS

The present invention will be described via detailed illustration of the preferred embodiment versus the prior art referring to the drawings wherein.

DETAILED DESCRIPTION OF PREFERRED EMBODIMENT

Figure 1:
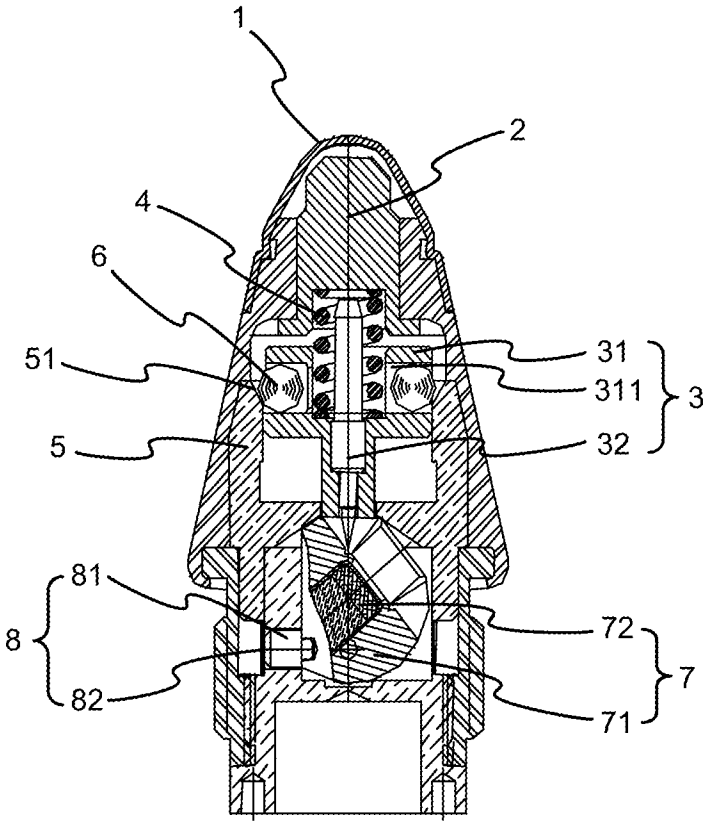
FIG. 1 is a cross-sectional view of a fuze for a high-spin self-destructing device according to the preferred embodiment of the present invention.

Referring to FIGS. 1 through 4, there is shown a fuze according to the preferred embodiment of the present invention. The fuze includes a shell 1, a plunger 2, a firing pin unit 3, a spring 4, a receptacle 5, a plurality of detents 8, a detonation unit 7, and a restraint unit 8.

The shell 1 may be made with various sizes to satisfy various needs. In detail, the shell 1 is sized corresponding to a bore defined in a launcher for launching a high-spin self-destructing device equipped with the fuze. The size of the launcher may be medium or small (such as 20 mm and 30 mm).

The plunger 2 is movably provided in the shell 1. The plunger 2 is located near a front end of the shell 1. The plunger 2 is made with a first end and a second end. The first end of the plunger 2 is located in the vicinity of the front end of the shell 1.

The firing pin unit 3 is movably provided in the shell 1, in the vicinity of the second end of the plunger 2. The firing pin unit 3 includes a seat 31 and a firing pin 32. The seat 31 includes a plurality of apertures 311 defined in the periphery. The firing pin 32 is provided in the seat 31.

The spring 4 is provided on and around the firing pin 32 of the firing pin unit 3. An end of the spring 4 is abutted against the second end of the plunger 2 while another end of the spring 4 is abutted against the seat 31. That is, the spring 4 is compressed between the plunger 2 and the seat 31.

The receptacle 5 is provided in the shell 1. The receptacle 5 is used to movably contain the seat 31 of the firing pin unit 3. The receptacle 5 includes a chamfered portion 51 at an end.

The detents 6 are movably provided between the firing pin unit 3 and the receptacle 5. The detents 6 may be in the form of a ball. Each of the detents 6 is provided in a related one of the apertures 311 of the seat 31 and abutted against the chamfered portion 51 of the receptacle 5.

The detonation unit 7 is movably provided in the receptacle 5, near another end of the receptacle 5. The detonation unit 7 includes a rotor 71 and a detonator 72 provided in the rotor 71.

The restraint unit 8 is provided in the shell 1 and movably connected to the rotor 71 of the detonation unit 7. The restraint unit 8 includes a centrifugal pin 81 movably connected to the detonation unit 7 and a centrifugal coil spring 82 connected to the centrifugal pin 81.

In storage or transportation, the restraint unit 8 is engaged with the detonation unit 7 to provide security and avoid dangers caused by interferences from the environment.

Figure 2:
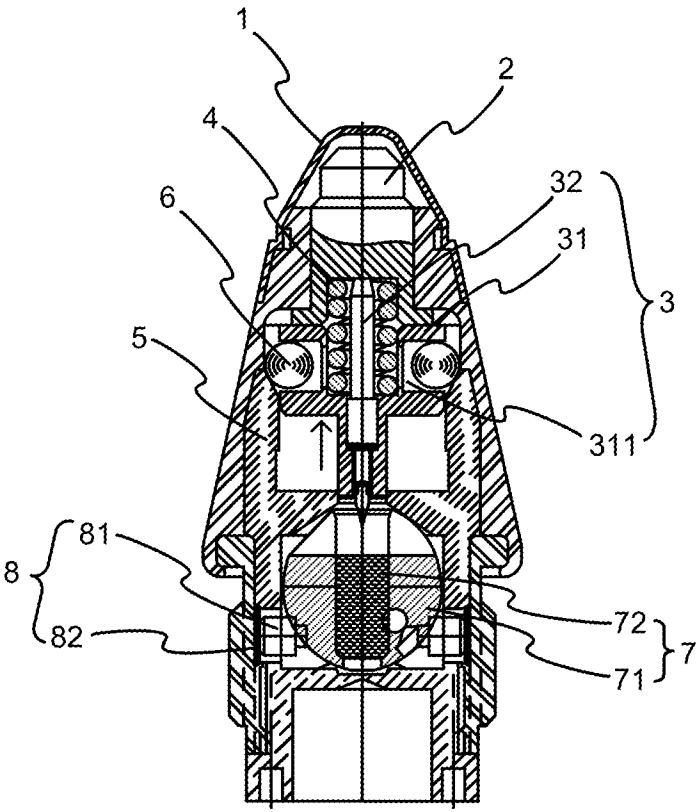
FIG. 2 is a cross-sectional view of the fuze in a ready position.

Referring to FIG. 2, the centrifugal pin 81 is subject to a centrifugal force that exceeds the force exerted by the centrifugal coil spring 82 when the high-spin self-destructing device is launched from the launcher. Thus, the centrifugal pin 81 is disengaged from the rotor 71. Because of centrifugal forces, the detents 6 slide upward along the chamfered portion 51 of the receptacle 5 and therefore push the spring 4. Thus, the rotor 71 is also subject to a centrifugal force and moved into a ready position.

Figure 3:
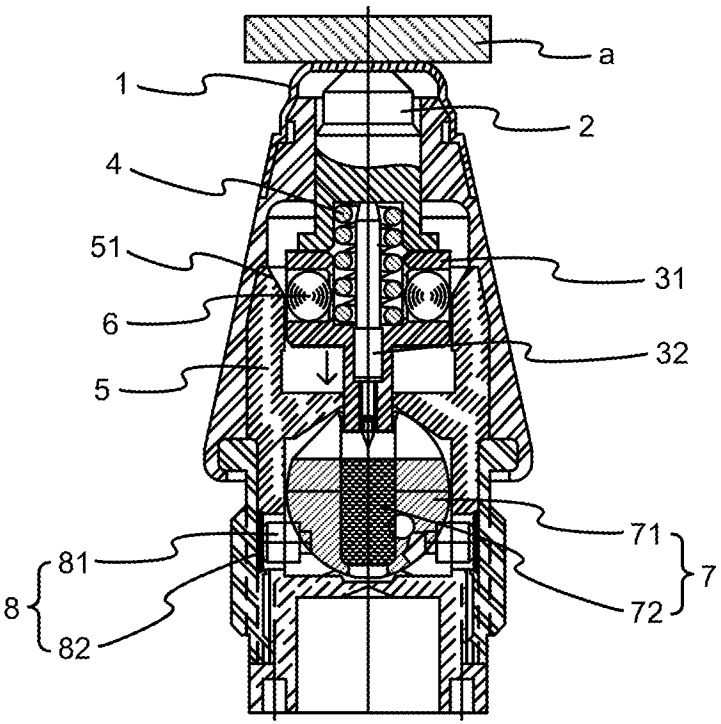
FIG. 3 is a cross-sectional view of the fuze in a triggered position.

Referring to FIG. 3, the shell 1 is deformed when it hits a target A. The plunger 2 is pushed as the shell 1 is deformed. Thus, the firing pin unit 3 is pushed by the plunger 2. Accordingly, the detonator 72 is triggered by the firing pin 32, and then dynamite included in the high-spin self-destructing device is ignited detonated by the detonator 72.

Figure 4:
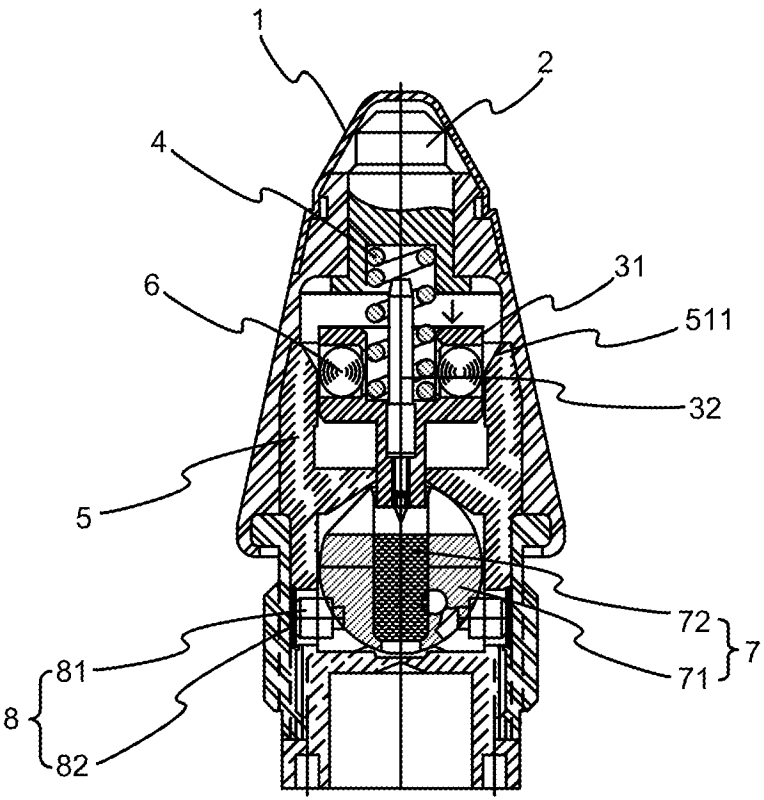
FIG. 4 is a cross-sectional view of the fuze in a self-destructing position.
Figure 5:
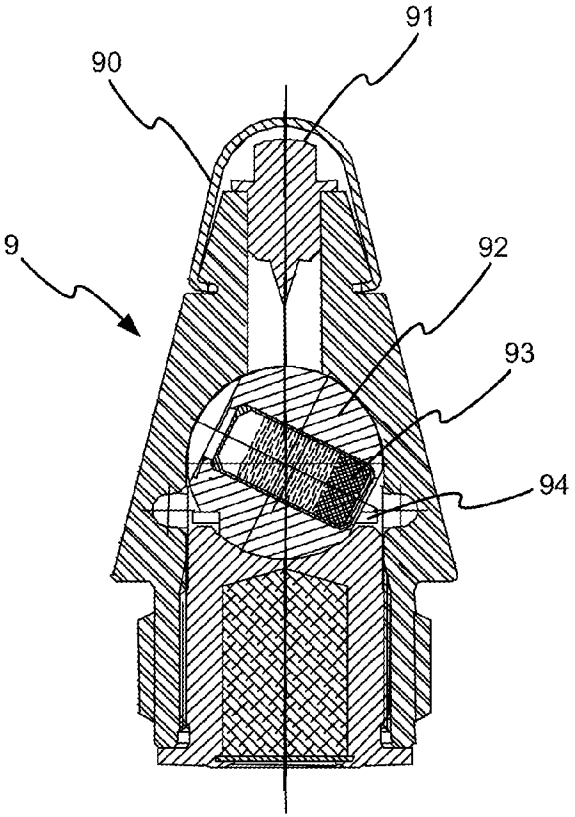
FIG. 5 (Prior Art)
FIG. 5 is a cross-sectional view of a conventional fuze for a high-spin self-destructing device.

The high-spin self-destructing device might miss the target A. For example, the high-spin self-destructing device is biased from the target A. In this case, it is preferred that the high-spin self-destructing device blows up before hitting the ground. Alternatively, the high-spin self-destructing device is aligned to the target A but the target A is out of the range of the high-spin self-destructing device. In this case, it is preferred that the high-spin self-destructing device blows up in the vicinity of the target A. To this end, friction between the high-spin self-destructing device and the air is used. The rotation of the high-spin self-destructing device is continuously reduced by the air because of the friction. Referring to FIG. 4, before the high-spin self-destructing device hits the target A or falls onto the ground, the rotation of the high-spin self-destructing device eventually drops to a value so that the force exerted by the spring 4 overcomes the centrifugal forces exerted on the detents 6. Hence, the seat 31 is pushed downward so that detonator 72 is triggered by the firing pin 32 provided in the seat 31. Finally, the dynamite is detonated by the detonator 72.

As discussed above, the fuze of the present invention exhibits at least two advantageous features. Firstly, it is secured in the storage or transportation as the restraint unit 3 is engaged with the detonation unit 7. Secondly, it is reliable because it blows up near the target A or the ground to maximize a damage of humans and/or facility.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A fuze for a high-spin self-destructing device, the fuze including:

a shell;

a plunger movably provided in the shell;

a firing pin unit movably provided in the shell, in the vicinity of the plunger;

a spring compressed between the plunger and the firing pin unit;

a receptacle provided in the shell and movably connected to the firing pin unit;

detents movably provided between the firing pin unit and the receptacle; and a detonation unit movably provided in the receptacle opposite to the detents, the detonation unit including: a rotor movably connected to a restraint unit; and a detonator provided in the rotor; the restraint unit provided in the shell and movably connected to the detonation unit, the restraint unit including: a centrifugal pin movably connected to the detonation unit; and a centrifugal coil spring connected to the centrifugal pin.

2. The fuze according to claim 1, wherein the shell can be made with various sizes.

3. The fuze according to claim 1, wherein the firing pin unit includes:

a seat provided in the receptacle; and a firing pin provided in the seat, wherein the spring is provided on and around the firing pin so that the spring is in contact with the plunger at an end and in contact with the seat at an opposite end.

4. The fuze according to claim 3, wherein the seat includes apertures each for containing a related one of the detents.

5. The fuze according to claim 1, wherein the receptacle includes a chamfered portion in contact with the detents.

6. The fuze according to claim 1, wherein each of the detents is a ball.

* * * * *